United States Patent [19]

Paul

[11] Patent Number: 4,485,505

[45] Date of Patent: Dec. 4, 1984

[54] VENTILATING, INFLATABLE MATTRESS

[76] Inventor: Patrick R. D. Paul, 916 Stillwater Dr., James Island, Charleston, S.C. 29412

[21] Appl. No.: 291,168

[22] Filed: Aug. 10, 1981

[30] Foreign Application Priority Data

Aug. 13, 1980 [GB] United Kingdom ..... 8026381

[51] Int. Cl.[3] ..... A61G 7/04; A47C 27/18; A47C 27/10

[52] U.S. Cl. ..... 5/453; 5/469; 5/449

[58] Field of Search ..... 5/449–453, 5/455, 469, 468

[56] References Cited

U.S. PATENT DOCUMENTS

| | | | |
|---|---|---|---|
| 2,785,739 | 3/1957 | McGreggor et al. | 5/481 |
| 3,446,203 | 5/1969 | Murray | 5/453 |
| 3,492,988 | 2/1970 | De Mare | 5/453 |
| 3,653,083 | 4/1972 | Lapidus | 5/453 |
| 3,822,425 | 7/1974 | Scales | 5/469 |
| 3,942,202 | 3/1976 | Chevrolet | 5/469 |
| 4,225,989 | 10/1980 | Corbatt et al. | 5/453 |

*Primary Examiner*—Alexander Grosz

*Attorney, Agent, or Firm*—Wellington M. Manning, Jr.; Luke J. Wilburn, Jr.

[57] ABSTRACT

A mattress unit comprises an inflatable base having resilient support cells on its upper surface, the tops of the cells supporting a patient, and a cover over the cells with a gas inlet to provide an increased pressure between the cover and the cells. The cover is perforated to allow ventilation of a patient. The unit is suitable for long-stay patients.

13 Claims, 4 Drawing Figures

VENTILATING, INFLATABLE MATTRESS

DESCRIPTION

This invention relates to mattresses especially but not exclusively suitable for hospital patients such as burn victims, para and quadraplegics and geriatric or other patients who need to remain in bed for a long period of time.

Such patients are prone to develop bed sores or decubitus ulcers when they lie in a fixed position over a long period. This condition can be serious and is caused primarily by a combination of heat, moisture, pressure and shear forces on the body areas in contact with the mattress on which the patient lies.

Attempts have been made to avoid this problem using special mattresses for supporting patients. One such mattress is made of foam rubber and has an upper supporting surface shaped as a network of truncated pyramids separated by valleys. This arrangement allows the flat-topped pyramids which actually support the patient's body to be depressed whereas the remaining pyramids remain at their "natural" level. Using such a mattress there is little or no horizontal force exerted by the mattress on the points of the patient's body which it supports. Also the foam rubber allows a certain degree of ventilation of the patient's body which is beneficial in avoiding unwanted heat and moisture.

However, such a mattress has the disadvantage that, being made of foam, it is difficult or impossible to clean. In practice the mattress has to be disposable, rendering the system expensive to use especially with incontinent patients. Also the degree of ventilation provided cannot be varied and in general is not really adequate.

According to the present invention there is provided a mattress unit comprising a hollow inflatable base support having a plurality of resilient upstanding support cells arranged on the upper surface of the base support, the tops of the cells being adapted to support a human body, the support cells being covered by a cover defining a gap between the support cells and the cover, and an inlet to allow feed of gas under pressure to said gap, the cover being perforated to allow said gas to escape upwardly.

The inflatable base support may consist of a whole mattress or it may form a replaceable insert to be mounted in a suitable cavity in the body of an ordinary mattress. The mattress may have a plurality of such cavities to receive corresponding inserts so that the overall layout of the mattress surface may be varied according to the needs of the patient. The mattress may have support cells of foam material, as in known mattresses, on the part of its upper surface not occupied by the cavities.

A mattress unit according to one embodiment of the invention will now be described by way of example with reference to the accompanying drawings in which.

Figure 1:
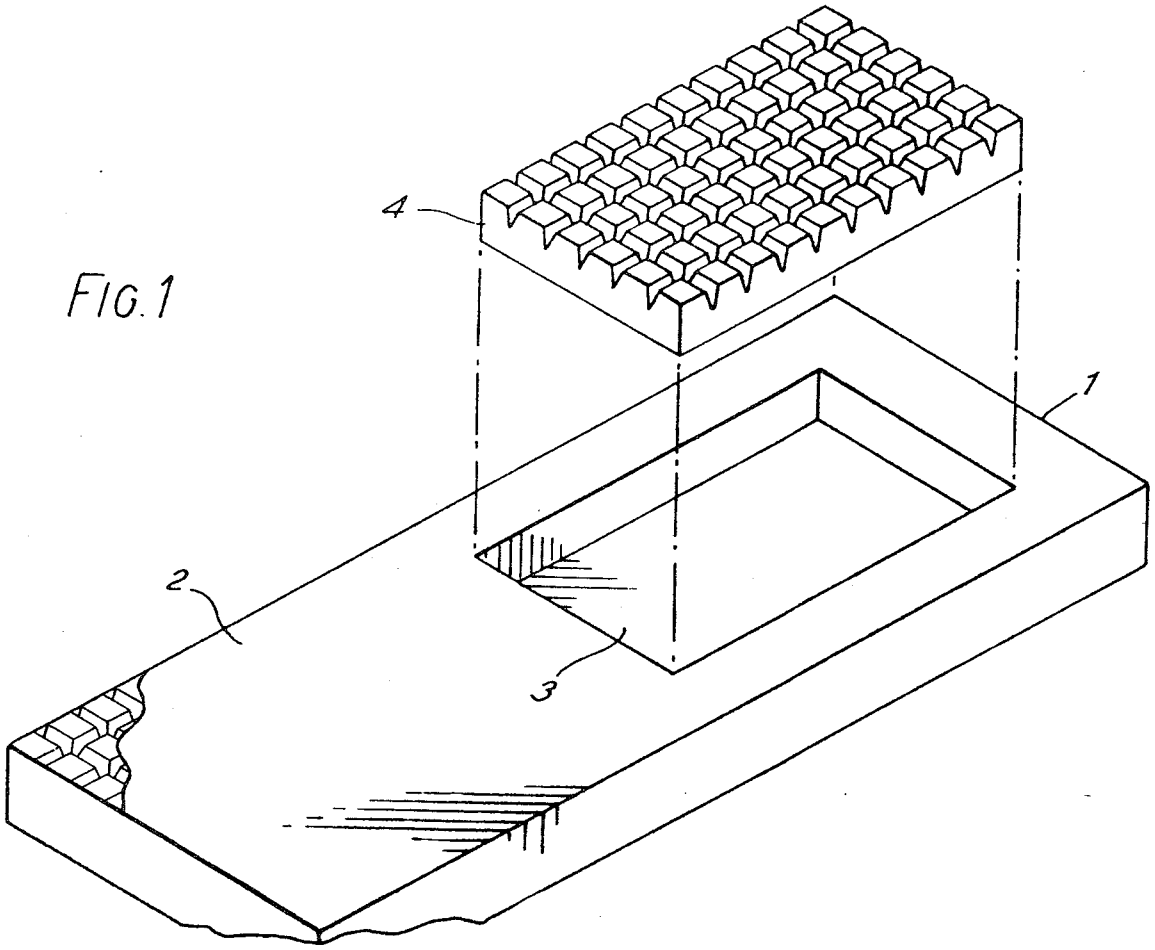
FIG. 1 is an isometric view of a mattress provided with an insert, the insert having been removed.

Referring to FIG. 1, mattress 1 is composed of a flexible foam material of a type commonly used in mattresses but the upper surface 2 of the mattress is provided with a rectangular cavity 3 capable of receiving a rectangular insert 4.

Figure 4:
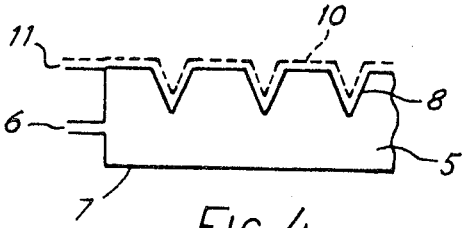
FIG. 4 is a section showing the structure of the insert.

As shown in FIG. 4 the insert 4 comprises a substantially airtight bag 5, of polyvinyl chloride or other sheet plastics material, having an inlet 6 to receive compressed air from a compressor (not shown in the drawings). The lower surface 7 of the bag is substantially flat but the upper surface 8 comprises upstanding truncated pyramids, separated by valleys, so that a person lying on the surface 8 of the insert rests on the more or less flat tops of the pyramids. The cells and valleys are such that depression of one cell by the weight of a human body lying on the insert will not distort an adjacent cell so that no horizontal forces are transmitted to the human body. The pressure in the bag may be adjusted to such a value as to maximise the area of the surface 8 in contact with the person's body without, however, the body lying on the bottom of the cavity at any point.

The surface 8 is covered by a covering 10 of the same truncated pyramidal shape as the surface 8 of a plastics material such as polyvinyl chloride. The covering 10 is arranged so that over the whole of surface 8 of the insert a small gap, of uniform width is provided between surface 8 and the underside of covering 10 when the space between them is subjected to a small increased air pressure. This increase may be provided by connecting an air compressor, not shown in the drawings, to an inlet 11. The width of the gap may be up to 15 mm, a typical value is 5 mm.

The covering 10 is provided with small perforations allowing upward escape of air from the gap. The perforations have a diameter from 0.01 mm to 0.5 mm, e.g. 0.025 mm and are distributed over the cover 10 in such a manner that the density of the perforations is greater on the upper surfaces of the truncated pyramids than in the lower portions defining the side walls of the pyramids. These perforations allow a slow escape of air fed to the gap through inlet 11, the rate of escape depending on the excess pressure applied. In use, the pressure applied within the gap by means of inlet 11 is rather greater than the pressure within the body of the insert and therefor greater than the pressure exerted on the pyramids by a person's body. Thus when a person lies on the insert the pyramids are depressed by the person's weight but an appreciable gap between the weight-bearing pyramids and the covering 10 is maintained and air will be emitted through the perforations.

Because of the positive pressure in the gap a continuous stream of air is emitted upwardly through the perforations and because of the increased density of the perforations this stream is more intense at the tops of the pyramids. A continuous stream of air is thus fed to the body of a person lying on the insert. The excess pressure in the gap is adjusted so that this stream is not obtrusive for the person.

Figure 2:
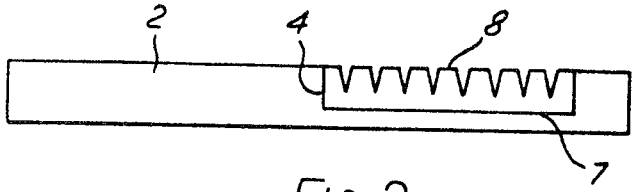
FIGS. 2 and 3 are sections of the mattress of FIG. 1 showing the insert in different positions.
Figure 3:
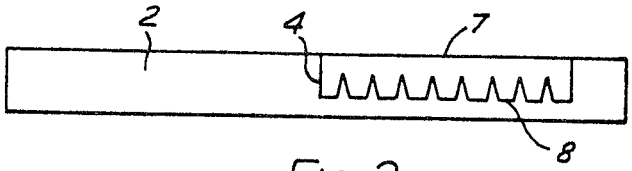

The mattress 1 may be provided with more than one cavity to receive an insert of the kind described. When the ventilated insert is in use it will be arranged as shown in FIG. 2 with the pyramids extending upwardly. When the mattress 1 is to be used as an ordinary mattress the insert may be put in the cavity with the pyramid directed downwardly, as shown in FIG. 3, to provide a flat upper surface on which a person may lie.

The part of the upper surface not occupied by the cavity may be planar or it may be occupied by fixed (i.e. not removable) upstanding cells, for example of foam material.

The arrangement described above has a number of advantages over the foam variable pressure mattress known in the prior art. The cover 10 may easily be cleaned, whereas soiled foam mattresses are difficult to clean and thus their use in hospitals is expensive, especially for incontinent patients. The continuous ventilation provided by the above arrangement is very beneficial in providing a continuous, comfortable drying of a patient's body and preventing maceration. With a foam mattress the pressure exerted on any part of the body is a function of the foam density, which for a given insert cannot be varied, and on the depression of the pyramid supporting that part of the body. With the above arrangement the pressures on each part of the body are equal, the air pressure in the bag 5 being uniform throughout the bag. The distribution of body weight is thus improved. The firmness of the mattress can be varied, according to the needs of a patient, by varying the pressures in the bag forming the body of the mattress or insert.

Instead of forming an insert for a cavity in a mattress as in the embodiment described above the "insert", or a number of inserts positioned side-by-side, may itself form a complete mattress.

I claim:

1. A mattress unit comprising a hollow inflatible base support having a plurality of resilient upstanding support cells arranged on the upper surface of the base support, the tops of the cells being adapted to support a human body such that depression of one cell by weight of the human body will not depress adjacent uncontacted cells, thus avoiding substantial horizontal forces against the human body, the support cells being covered by a cover defining a gap between the support cells and the cover, said cover having a like configuration as said upper surface of said base support, and an inlet to allow gas under pressure to said gap, the cover being perforated to allow gas to escape upwardly.

2. A mattress unit according to claim 1, in which said cells comprise upstanding truncated pyramids separated by valleys.

3. A mattress unit according to claim 1 or 2, in which the support cells have substantially flat tops to support a patient lying on the mattress.

4. A mattress unit according to claim 1, in which the cover adjacent the tops of the cells has a greater density of perforations than the remainder of the cover.

5. A mattress unit according to claim 4, in which the perforations have a diameter from 0.01 to 0.5 mm.

6. A mattress unit according to claim 1, in which when gas is fed under pressure to said inlet the width of the gap is substantially uniform over substantially the whole area of the unit occupied by said cells.

7. A mattress unit according to claim 6, in which the width of said gap is up to 15 mm.

8. A mattress unit according to claim 1, in which the base support and cover are formed of a sheet plastics material.

9. A mattress unit according to claim 1, provided with a source of compressed gas for said inlet, the arrangement being such that the gas pressure generated in said gap is slightly greater than the pressure in the base support.

10. A mattress unit according to claim 1, in which the lower surface of the base support is substantially planar.

11. A mattress assembly, comprising a mattress provided with at least one cavity and a mattress unit according to claim 1 adapted to occupy said cavity.

12. A mattress assembly according to claim 11, comprising a plurality of mattress units adapted to occupy said cavity side-by-side.

13. A mattress assembly according to claim 11, provided with fixed resilient upstanding support cells of a foam material on part of its upper surface, the remainder of its upper surface being occupied by said cavity.

* * * * *